United States Patent [19]

Frazier et al.

[11] Patent Number: 4,565,246

[45] Date of Patent: Jan. 21, 1986

[54] RECIPROCATING PUMP WITH PARTIAL FLOW REVERSAL

[75] Inventors: Terry L. Frazier, Paso Robles, Calif.; Jan D. Dozier, Huntsville, Ala.

[73] Assignee: Texaco, Inc., White Plains, N.Y.

[21] Appl. No.: 562,900

[22] Filed: Dec. 19, 1983

[51] Int. Cl.[4] ..... E21B 43/25

[52] U.S. Cl. ..... 166/112; 166/305.1; 166/370; 166/68

[58] Field of Search ..... 166/112, 305 R, 369, 166/68, 105, 370, 106; 417/430, 495

[56] References Cited

U.S. PATENT DOCUMENTS

| | | | |
|---|---|---|---|
| 626,949 | 6/1899 | Wheeler | 166/112 |
| 955,024 | 4/1910 | Walker et al. | 166/112 |
| 2,630,070 | 3/1953 | Davis | 166/106 |
| 2,897,768 | 8/1959 | Perry | 166/105 |

*Primary Examiner*—Stephen J. Novosad
*Assistant Examiner*—Michael Goodwin
*Attorney, Agent, or Firm*—Robert A. Kulason; Henry D. Dearborn

[57] ABSTRACT

A reciprocating type oil well pump. It employs modifications of standard pump structure in order to obtain a reverse flow pulse during each pumping cycle. The pump barrel has a port near the upper end of the stroke, and the traveling valve is spring loaded against a desired pressure. The piston closes the port during the lower portion of the stroke.

10 Claims, 2 Drawing Figures

RECIPROCATING PUMP WITH PARTIAL FLOW REVERSAL

BRIEF SUMMARY OF THE INVENTION

This invention concerns oil well pumping in general. More specifically, it relates to a pump structure which can provide reversing flow pulsations in order to reduce blockage by mobile fines in the produced fluids.

In oil well production there is often a problem with loss of the production rate due to mobile fines in the reservoir. There is an article by T. W. Muecke that was published in the February 1979 issue of JOURNAL OF PETROLEUM TECHNOLOGY at pages 144–150, which discussed the phenomenon in detail. And, the article included as one of its conclusions that pulsing flow might cause less plugging than continuous flow. However, there has not been any known apparatus developed for providing such flow.

Consequently, it is an object of this invention to provide a reciprocating pump having the capability to produce some flow reversal during each pumping cycle.

Briefly, the invention concerns cyclical pumping means for use in oil wells and the like. It comprises means for pumping fluids in one direction during part of said cycle, and means for pumping said fluid in the opposite direction during another part of said cycle. It also comprises means for determining the ratio of fluid pumped in said two directions whereby pulsing flow of fluid is obtained.

Again briefly, the invention is in combination with a reciprocating type oil well pump having a cylinder and piston. The said cylinder has a standing check valve at one end, and the said piston has a traveling check valve therein. There is means for reversing the direction of flow of fluid pumped during a portion of each cycle, which means comprises means for bypassing said standing check valve during said reversing portion of each cycle, and means for holding said traveling check valve closed during said reversing portion of each cycle.

Again briefly, the invention is in a pumping well subject to formation bridging by mobile fines where said well employs a lift-type reciprocating pump having pumping cycles including a lift stroke during which fluid flows from said formation toward said pump and from said pump to the surface, and a return stroke during which said pump recovers. In the foregoing, the invention is a method for reducing said formation bridging which comprises pumping said fluid in reverse during a portion of said return stroke to cause fluid to flow from said pump toward said formation.

Again briefly, the invention is in a reciprocating type pump for lifting fluids from wells and the like, subject to blockage from mobile fines. The said pump has a pump barrel with a standing check valve at the bottom, a pump plunger with a ball-type traveling check valve at the bottom, and means for reciprocating said plunger in said barrel over a predetermined stroke distance. In the foregoing pump the improvement comprises a port through the side wall of said barrel located between 10 and 40 percent of said stroke distance from the top thereof. The said plunger extends far enough to reach from the bottom of said stroke a sufficient distance above said port so as to maintain said port closed during the lower portion of said stroke. And, there is a helical spring for biasing said traveling check valve ball against back pressure which is less than a predetermined amplitude whereby said fluid is pumped back in reverse flow during said ten to forty percent stroke distance.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENTS

Figure 1:
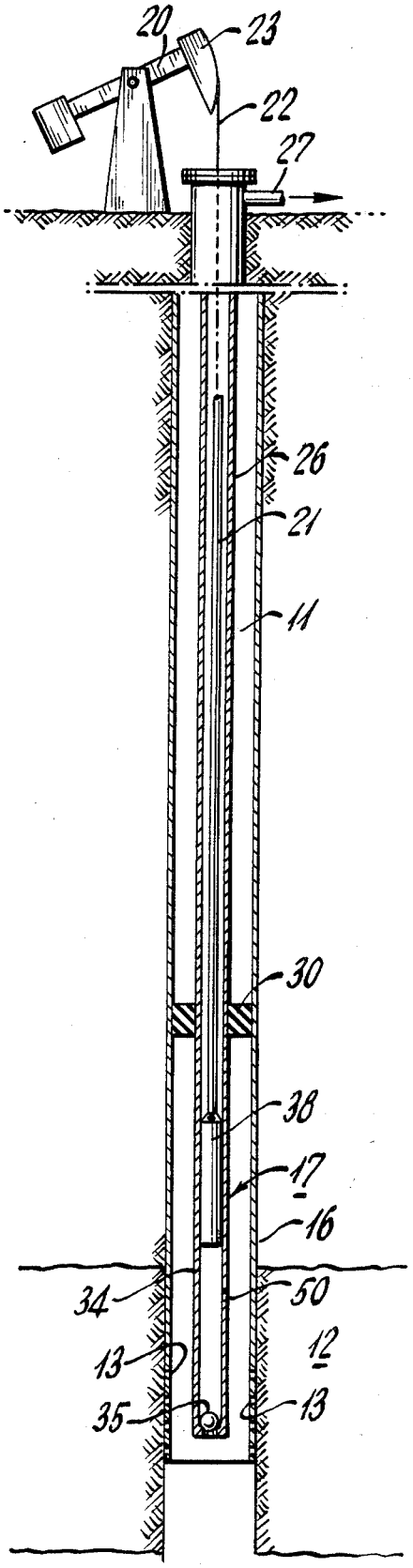
FIG. 1 is a schematic cross-sectional showing of a well being pumped with pump structure according to the invention located down hole.

A problem that is related to the producing of oil and other products from oil wells is one which has been encountered frequently. It is because of mobile fines that are encountered in many producing formations. Such fines tend to bridge the pores of a producing formation and clog or block the rate of flow of the produced product.

While the foregoing problem has been recognized and studied as reported in the above mentioned article by T. W. Muecke published in February 1979 JOURNAL OF PETROLEUM TECHNOLOGY at page 144–150, there has been no known suggestion since that time of any means for carrying out a flow reversal of the sort suggested. However, by modifying the structure of a reciprocating pump of the sort employed in oil fields in accordance with this invention, a pulsing flow as desired may be obtained. And, a preferred embodiment of the invention is illustrated in the drawings.

Referring to FIG. 1 of the drawings, there is a schematic illustration that shows a well 11 which is producing from a subsurface formation 12. And, the produced fluid flows through perforations 13 in a casing 16.

There is a pump 17 that is located down in the well 11. It is a reciprocating type and it is driven from the surface by a conventional rocker arm 20 that is connected to a string of sucker rods 21 via a flexible cable 22. Cable 22 is attached to a horsehead 23 for maintaining vertical force on the sucker rod string in a conventional manner. The pumped fluid is lifted inside of a tubing string 26 to be delivered at the surface through a pipe 27. As will appear hereafter, there may be a packer 30 which surrounds the tubing string 26 at a location above the pump 17.

Figure 2:
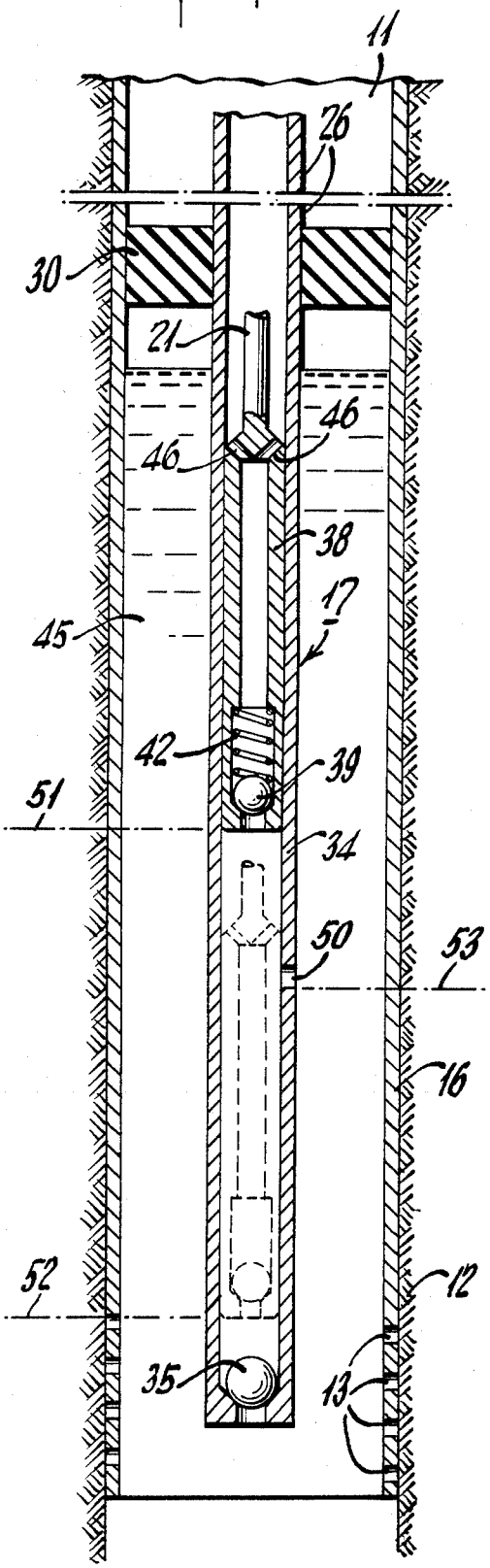
FIG. 2 is an enlarged cross-sectional showing of the lower portion of the hole with pump structure according to the invention in place therein.

FIG. 2 illustrates the pump structure according to this invention, in greater detail. It may be noted that the elements of the pump 17 include a standard barrel portion 34 that has a cylindrical interior. Barrel 34 contains a standing check valve 35 at the bottom thereof. And, there is a hollow piston 38 that is a close fit with the interior of the barrel 34 so as to act as the pump plunger in a conventional manner. The piston 38 has a traveling check valve 39 contained at the bottom thereof. And, in connection with this invention, there is a coil spring 42 that biases the check valve 39 closed until a predetermined differential pressure from below is reached.

It will be understood that well fluid 45 will gather at the bottom of the well 11 and rise above the level of the pump 17. Then, as reciprocating pumping action takes place, fluid 45 will flow into the pump barrel 34 past the standing check valve 35, during each up stroke of the pump 17. At the same time fluid that has previously passed the traveling check valve 39 into the interior of the hollow piston 38 will be lifted and added to the total fluid flow up through passages 46 that connect into the interior of the tubing string 26. Thus, the total pumped flow is upward and out through the surface pipe 27.

Two principal features of this invention are: one, the addition of port 50 through the side wall of the barrel 34, and two, the strength of the coil spring 42. The port 50 is situated at a predetermined location in the upper portion of a stroke of the piston 38. In the FIG. 2 illustration the bottom of piston 38 travels from an upper location 51 at the top of the stroke, to a lower location 52 at the bottom. A preferred location for the port 50 is between 10 and 40 percent of the stroke distance taken between the upper and lower locations 51 and 52, from the top.

OPERATION

With reference to FIG. 2, the operation of the pump may be described as follows. On the up stroke, the produced well fluid 45 will flow through check valve 35 into the interior of the barrel 34. This will take place as the plunger, i.e. hollow piston 38 moves upward during the up stroke of a pumping cycle.

As the piston 38 starts downward from the location 51 at the top of the stroke, the traveling check valve 39 will remain closed until the port 50 is reached. That is because of the bias force applied by the coil spring 42. Consequently, fluid in the top portion of the interior of the barrel 34 will be pumped outward through the port 50 bypassing the standing check valve 35. This provides a relatively short back injection or reverse pulse of fluid flow. Such reverse is backward toward the formation 12 through the perforations 13. Consequently it tends to loosen the fines which would block the producing formation.

When the bottom of the piston 38 passes the port 50, the fluid in the barrel 34 can no longer bypass standing check valve 35, which is of course closed, and consequently that fluid will be compressed. As soon as the compression is sufficient to overcome the bias force of spring 42, the traveling valve 39 will be opened so as to permit the fluid to fill the hollow interior of the piston 38. Thereafter when the piston 38 has reached the bottom of the stroke (indicated in in dashed lines) and starts moving upward, the fluid will be lifted in the usual manner as the piston goes to the top of the stroke on each pump cycle. Consequently the fluid in the tubing 26 is pumped upward and out at the surface. It should be noted that the piston 38 must be long enough to maintain the port 50 covered, i.e. closed throughout the lower portion of each pumping cycle so that the pump will act properly without any unwanted bypassing of the standing valve 35. Such length of the piston 38 is indicated by the dashed line showing of the piston in its lowest position during each pumping cycle.

It will be understood that the force applied by the coil spring 42 (on the traveling valve 39) should be determined for each particular well with regard to the conditions to be encountered. Thus, the required force can be estimated in the following manner. Assuming that the well bore bottom hole producing pressure is 100 pounds per square inch, and the traveling valve seat diameter is one inch, the valve area is determined by the expression $\pi D^2/4 = 3.14\ (1)^2/4 = 0.7854$ square inches. The force required to just keep the valve closed is 100 psi $\times$ 0.7854 $in^2 = 78.5$ lb. Using an additional safety factor estimated as 1.2 for a multiplier, the force may be calculated and the result is 94 lbs spring pressure. That provides the force which is sufficient to prevent the traveling valve from opening when it is above the back injection port 50, but allows it to open when below the port since the pressure then builds quickly to exceed the 94 lbs. of force. Consequently the pump operates by opening the traveling valve for the remainder of the down stroke which permits fluid to enter the interior of the piston 38.

It will be understood that the location of the back injection port 50 controls the back injection volume or percentage of the fluid during each pumping cycle. Thus, at the beginning of the plunger down stroke both the standing valve 35 and the traveling valve 39 will be closed. As the piston 38 (i.e. plunger) moves downward, fluid in the pump barrel 34 will be forced out the back injection port 50. Clearly, the lower the back injection port 50 is located on the pump barrel 34 the greater will be the back injection volume each pump cycle. In the case where the fluid being pumped is a liquid, the back injection percentage will be determined by the ratio of the distance from the top of the stroke 51 to a location 53 (bottom of port 50), divided by the total distance from the top of the stroke 51 to the bottom of the stroke 52, times 100. However, if gas is present, the back injection percentage will be somewhat reduced by an amount that must be determined by experience. Also, it will be understood that the amount of fluid that actually re-enters the formation will depend upon near well bore reservoir pressure, system transmissibility, and the amount of gas present. It will be noted that by using the packer 30 to seal the annular space between the tubing 26 and the well bore casing 16, a higher percentage of the back injection volume will be forced back into the formation 12.

While a particular embodiment of the invention has been described above in considerable detail in accordance with the applicable statutes, this is not to be taken as in any way limiting the invention but merely as being descriptive thereof.

We claim:

1. In a reciprocating type pump for lifting fluid from wells and the like subject to blockage by mobile fines, said pump having a pump barrel with a standing check valve at the bottom, a pump plunger with a traveling check valve at the bottom, and means for reciprocating said plunger in said barrel over a predetermined stroke distance having an upper limit of travel and a lower limit of travel, the improvement comprising a port in said barrel located above the middle of said stroke distance, means associated with said plunger for closing said port during said stroke distance while said plunger is below said port, and means for biasing said traveling check valve closed against back pressure less than a predetermined value whereby said fluid is pumped back to reverse flow and unblock said mobile fines during part of said stroke distance.

2. The invention according to claim 1, wherein said port is located between 10 and 40 percent of said stroke distance from said upper limit of travel.

3. The invention according to claim 1, wherein said means associated with said plunger comprises an extension of said plunger to reach from the bottom of said stroke distance to above said port when located at the bottom of said stroke.

4. The invention according to claim 1, wherein said traveling check valve biasing means comprises spring means.

5. The invention according to claim 4, wherein said traveling check valve is a ball type and said biasing means is a helical spring.

6. The invention according to claim 4, wherein, said means associated with said plunger comprises an extension of said plunger to reach from the bottom of said stroke distance to above said port when located at the bottom of said stroke.

7. The invention according to claim 6, wherein said port is located between 10 and 40 percent of said stroke distance from said upper limit of travel.

8. In a reciprocating type pump for lifting fluid from wells and the like subject to blockage by mobile fines, said pump having a pump barrel with a standing check valve at the bottom, a pump plunger with a ball type traveling check valve at the bottom, and means for reciprocating said plunger in said barrel over a predetermined stroke distance having an upper limit of travel and a lower limit of travel, the improvement comprising a port through the side wall of said barrel located between 10 and 40 percent of said stroke distance from said upper limit of travel, said plunger extending far enough to reach from the bottom of said stroke distance to above said port to maintain said port closed during the lower portion of said stroke, and a helical spring for biasing said traveling check valve ball against back pressure less than a predetermined value whereby said fluid is pumped back in reverse flow during said stroke distance above said port.

9. In combination with a reciprocating type oil well pump having a cylinder and piston, said cylinder having a standing check valve at one end, and said piston having an upper limit of travel and a lower limit of travel and having a traveling check valve therein, means for reversing the direction of flow of fluid pumped during a portion of each cycle, comprising a back flow port in said cylinder for bypassing said standing check valve during said reversing portion of each cycle, said back flow port being located less than half the distance of travel of said piston from said upper limit of travel, and means for biasing said traveling check valve closed up to a predetermined back pressure for holding said traveling check valve closed during said reversing portion of each cycle.

10. The invention according to claim 9, wherein said back flow port is located between 10 and 40 percent of the distance of travel of said piston from said upper limit of travel during each cycle.

* * * * *